US007105781B2

(12) United States Patent
Wilkins et al.

(10) Patent No.: US 7,105,781 B2
(45) Date of Patent: Sep. 12, 2006

(54) APPARATUS AND METHOD FOR DETECTING ABNORMAL TEMPERATURE RISE ASSOCIATED WITH A COOKING ARRANGEMENT

(75) Inventors: Peter Ravenscroft Wilkins, Droitwich (GB); Neil Swann, Bromsgrove (GB); Frederick James Davis, Droitwich (GB); Isobel Pearce, Stourbridge (GB)

(73) Assignee: Ceramaspeed Limited, (GB)

( * ) Notice: Subject to any disclaimer, the term of this patent is extended or adjusted under 35 U.S.C. 154(b) by 24 days.

(21) Appl. No.: 10/867,301

(22) Filed: Jun. 14, 2004

(65) Prior Publication Data

US 2005/0016990 A1 Jan. 27, 2005

(30) Foreign Application Priority Data

Jun. 16, 2003 (GB) ..... 0313831.0

(51) Int. Cl.
*H05B 1/02* (2006.01)

(52) U.S. Cl. ..... 219/494; 219/497; 219/481

(58) Field of Classification Search ..... 219/481, 219/490, 494, 497, 505, 501
See application file for complete search history.

(56) References Cited

U.S. PATENT DOCUMENTS 5,352,864 A 10/1994 Schultheis et al.
6,300,606 B1 10/2001 Engelmann et al.
6,384,384 B1 5/2002 Connolly et al.

FOREIGN PATENT DOCUMENTS

EP 0652688 10/1994
WO WO9516230 7/1995

OTHER PUBLICATIONS

United Kingdom Search Report, Oct. 10, 2003.
International Search Report, Sep. 17, 2004.

*Primary Examiner*—Mark Paschall
(74) *Attorney, Agent, or Firm*—Ira S. Dorman

(57) ABSTRACT

Apparatus and a method are provided for detecting an abnormal rise in temperature associated with a combination of a cooking utensil (10) and a cooking zone (8) of a cooking surface (4) overlying an electric heater (6). The apparatus has a first temperature-responsive device (24) is provided within the heater and adapted to monitor temperature of the cooking surface (4). A second temperature-responsive device (26) is provided within the heater and adapted to monitor temperature of the cooking utensil (10) through the cooking surface (4) to provide an electrical output as a function of temperature of the cooking utensil. Means (28) is provided for calculating first and second derivatives (D1, D2) with time of the temperature sensed by the second temperature-responsive device (26) over an operating temperature range of the heater. Means (28) is provided to determine stabilization of the first derivative (D1) within stabilizing threshold limit values. Means (28) is provided to thereafter compare the first and second derivatives (D1, D2) with first and second predetermined threshold values and to detect an abnormal rise in temperature when the first and second predetermined threshold values are exceeded.

38 Claims, 6 Drawing Sheets

APPARATUS AND METHOD FOR DETECTING ABNORMAL TEMPERATURE RISE ASSOCIATED WITH A COOKING ARRANGEMENT

This invention concerns apparatus and a method for detecting an abnormal rise in temperature associated with a combination of a cooking utensil and a cooking surface, such as of glass-ceramic material, overlying an electric heater. Such abnormal rise in temperature may, in particular, result from a boil-dry event in the cooking utensil or an event in which a food product adheres to a base of the cooking utensil.

BRIEF DESCRIPTION OF PRIOR ART

It is known to provide an electric heater arranged at the underside of a cooking surface, such as of glass-ceramic material, and in which the heater incorporates at least one electric heating element spaced from the underside of the cooking surface. A cooking utensil is arranged to be supported on the cooking surface in a cooking zone overlying the heater. It is known to provide a first temperature-responsive device, for example in a cavity between the at least one heating element and the underside of the cooking surface, to monitor temperature within the cavity and of the cooking surface and to operate to de-energise the heater when a predetermined maximum permitted temperature is sensed, thereby preventing thermal damage from occurring to the cooking surface. Such first temperature-responsive device may be arranged to provide an electrical output as a function of the temperature sensed and may be arranged to be electrically connected to control circuitry, which may be microprocessor-based.

It is also known to provide a second temperature-responsive device arranged in contact with, or adjacent to, the underside of the cooking surface within the cooking zone and operating to provide an electrical output to monitoring and control circuitry as a function of the temperature of the cooking utensil through the cooking surface within the cooking zone. Such second temperature-responsive device may be used to closely monitor the temperature of the cooking utensil and to provide a closed loop control system in which the heater is appropriately energised to provide a desired heating schedule for the cooking utensil.

When a boil-dry event occurs in the cooking utensil, or a food product being cooked in the cooking utensil adheres to the base thereof, a rise in temperature occurs in the cooking utensil, which temperature rise can be detected through the cooking surface. It is desirable to be able to monitor this rise in temperature by means of the second temperature-responsive device and to immediately de-energise the heater and/or provide a warning to a user. However, the rise in temperature may be small and may occur gradually rather than suddenly and a sufficiently rapid response is difficult to achieve.

An attempted solution to this problem is described in U.S. Pat. No. 6,300,606. Here only a single temperature sensor is used and three separate schemes are required to detect a boil-dry event, depending on how close the monitored temperature is to a cut-off point. At a temperature well below the cut-off point, first and second derivatives of a temperature-time curve are determined. A boil-dry event is detected when a) the first derivative is positive, b) the second derivative is positive, and c) power to the heater has not been changed for a predetermined time to increase the power. Clearly the requirement for three separate schemes is undesirably complex. Additionally, it has been found that the above scheme is unreliable, especially where the power to the heater is changed frequently.

OBJECT OF THE INVENTION

It is therefore an object of the present invention to provide an apparatus and a method for detecting an abnormal rise in temperature associated with a combination of a cooking utensil and a cooking surface which overcomes or at least ameliorates the abovementioned disadvantages.

SUMMARY OF THE INVENTION

According to one aspect of the present invention there is provided apparatus for detecting an abnormal rise in temperature associated with a combination of a cooking utensil and a cooking surface overlying an electric heater, the apparatus comprising a first temperature-responsive device adapted to monitor temperature of the cooking surface; a second temperature-responsive device adapted to monitor temperature of the cooking utensil and to provide an electrical output as a function of temperature of the cooking utensil; means for calculating first and second derivatives with time of the temperature sensed by the second temperature-responsive device over an operating temperature range of the heater; means to determine stabilisation of the first derivative within stabilising threshold limit values; and means to thereafter compare the first and second derivatives with first and second predetermined threshold values and to detect an abnormal rise in temperature when the first and second predetermined threshold values are exceeded.

According to another aspect of the present invention there is provided a method of detecting an abnormal rise in temperature associated with a combination of a cooking utensil and a cooking surface overlying an electric heater, comprising the steps of: monitoring, with a first temperature-responsive device, temperature of the cooking surface; monitoring, with a second temperature-responsive device, temperature of the cooking utensil and providing an electrical signal as a function of temperature of the cooking utensil; calculating first and second derivatives with time of the temperature sensed by the second temperature-responsive device over an operating temperature range of the heater; determining stabilisation of the first derivative within stabilising threshold limit values; and thereafter comparing the first and second derivatives with first and second predetermined threshold values to detect an abnormal rise in temperature when the first and second threshold values are exceeded.

The first and/or second temperature-responsive device may be provided within the heater.

The second temperature-responsive device may be adapted to monitor temperature of the cooking utensil through the cooking surface.

The first temperature-responsive device may be adapted to provide an electrical output as a function of the temperature of the cooking surface and may be electrically connected to means for monitoring temperature of the cooking surface sensed thereby with time.

The means to determine stabilisation of the first derivative within the stabilising threshold limit values may comprise a stabilising mode of operation of the heater, which is effected until the first derivative is stable within the stabilising threshold limit values for a predetermined period of time, such as about 20 seconds, and during which the first and second predetermined threshold values are arranged to be inoperative, whereby spurious detection of an abnormal rise in temperature is avoided, the stabilising mode of operation being followed by a running mode of operation during which the first and second predetermined threshold values are operative.

The running mode of operation may progress if power to the heater remains substantially constant and/or if a set-point temperature of the cooking surface, determined by a control means for the heater co-operating with the first temperature-responsive device, remains constant within predetermined limits and/or if the temperature sensed by the second temperature-responsive device does not decrease by more than a predetermined amount as specified by negative threshold limit values for the first and second derivatives, otherwise the stabilising mode of operation is re-selected.

The first temperature-responsive device may be arranged to operate to cause de-energising of the at least one heating element when it senses a predetermined maximum permitted temperature of the cooking surface.

The second temperature-responsive device may be arranged to operate to cause de-energising of the heater when it senses a predetermined maximum permitted temperature of the underside of the cooking utensil.

In a particular embodiment: the second temperature-responsive device monitors the temperature of the cooking utensil at predetermined time intervals and temperature values are entered into a stabilising buffer, where they are averaged; the average temperature in the stabilising buffer is calculated and entered into a first derivative buffer; the average value of the first derivative buffer is calculated and entered into a second derivative buffer and the buffers operate continually such that a first and second derivative value is outputted at each of the predetermined time intervals.

The predetermined time intervals may be between 0.1 and 4 seconds, preferably between 0.3 and 1 second and suitably about 0.5 second.

The first and/or second temperature-responsive device(s) may be of electrical resistance temperature detector form, such as of platinum resistance temperature detector form.

The second temperature-responsive device may be arranged in contact with or adjacent to the underside of the cooking surface.

Microprocessor-based processing, calculating and control circuitry, operating with appropriate software algorithms, may be provided for operation in association with the first and second temperature-responsive devices, the electric heater and a power supply.

The cooking surface may comprise glass-ceramic material.

The abnormal rise in temperature associated with the combination of the cooking utensil and the cooking surface overlying the heater may result from a boil-dry event in the cooking utensil or an event in which a food product adheres to a base of the cooking utensil.

The electric heater may incorporate at least one electric heating element selected from a radiant electrical resistance heating element and an electrical induction heating element.

In the present invention, the provision of the stabilising mode of operation results in a sensitive system which accurately detects and rapidly responds to a boil-dry or similar event associated with the cooking utensil on the cooking surface.

For a better understanding of the present invention and to show more clearly how it may be carried into effect, reference will now be made, by way of example, to the accompanying drawings in which:

DESCRIPTION OF PREFERRED EMBODIMENTS

Figure 1:
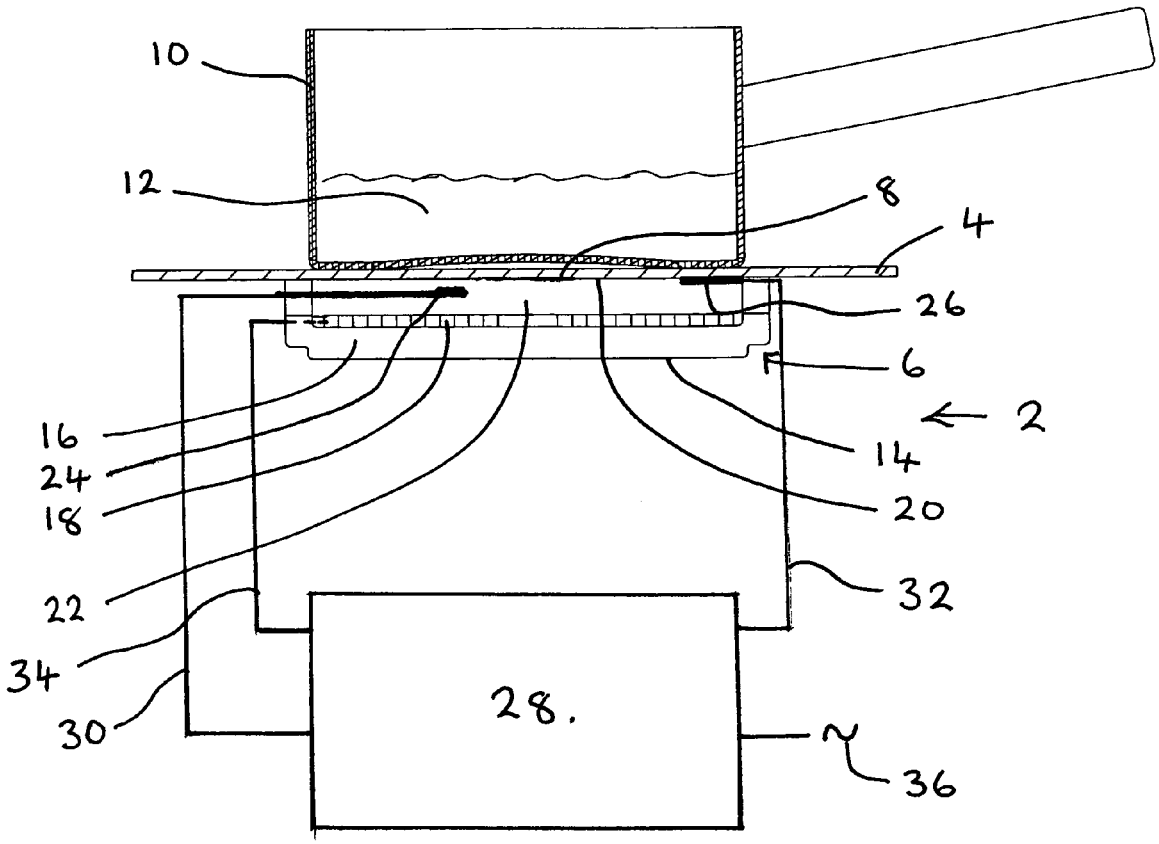
FIG. 1 is a cross-sectional view of a cooking utensil supported on a cooking zone of a cooking surface under which is an electric heater, electrically connected to means for detecting an abnormal rise in temperature in the cooking zone, according to the present invention.

Referring to FIG. 1, a cooking arrangement 2 comprises a cooking surface 4, such as of glass-ceramic material, at an underside of which is supported an electric heater 6. A cooking zone 8 is provided on the cooking surface 4. A cooking utensil 10 containing, for example, 200 ml of water to be heated, is located on the cooking surface 4 at the cooking zone 8.

The heater 6 comprises a dish-like support 14 containing a base layer 16 of thermal insulation material and supporting at least one radiant electrical resistance heating element 18. Instead of the at least one radiant electrical resistance heating element 18, at least one electrical induction heating element of known form could be provided. The at least one heating element 18 is spaced from the underside 20 of the cooking surface 4, such that a cavity 22 is formed.

A first temperature-responsive device 24 is located inside the cavity 22 and suitably comprises an electrical resistance temperature detector, such as a platinum resistance temperature detector, which provides an electrical output as a function of temperature of the cooking surface 4.

A second temperature-responsive device 26 is provided, located in contact with, or adjacent to, the underside 20 of the cooking surface 4, within the cooking zone 8 and is adapted to provide an electrical output as a function of temperature of the cooking utensil 10 through the cooking surface 4 within the cooking zone 8. The second temperature-responsive device 26 suitably comprises an electrical resistance temperature detector, such as a platinum resistance temperature detector.

A microprocessor-based processing, calculating and control circuit 28, operating with appropriate software algorithms, is electrically connected to the first temperature-responsive device 24 by leads 30 and is electrically connected to the second temperature-responsive device 26 by leads 32. The processing, calculating and control circuit 28 is also electrically connected by leads 34 to the at least one heating element 18 and is arranged to control energising of the at least one heating element 18 from a power supply 36.

Operation of the cooking arrangement 2 is now described with reference to FIGS. 2 and 3. The processing circuit 28, in association with the first temperature-responsive device 24, operates to adjust the power of the at least one heating element 18 to maintain a set-point temperature with time as indicated by reference numeral 38 in FIG. 2. In the case of the illustrated embodiment the set-point temperature is substantially 700 degrees Celsius. The processing circuit 28 may also operate to de-energise the heater 6 if a maximum predetermined temperature of the cooking surface 4 is exceeded.

Figure 2:
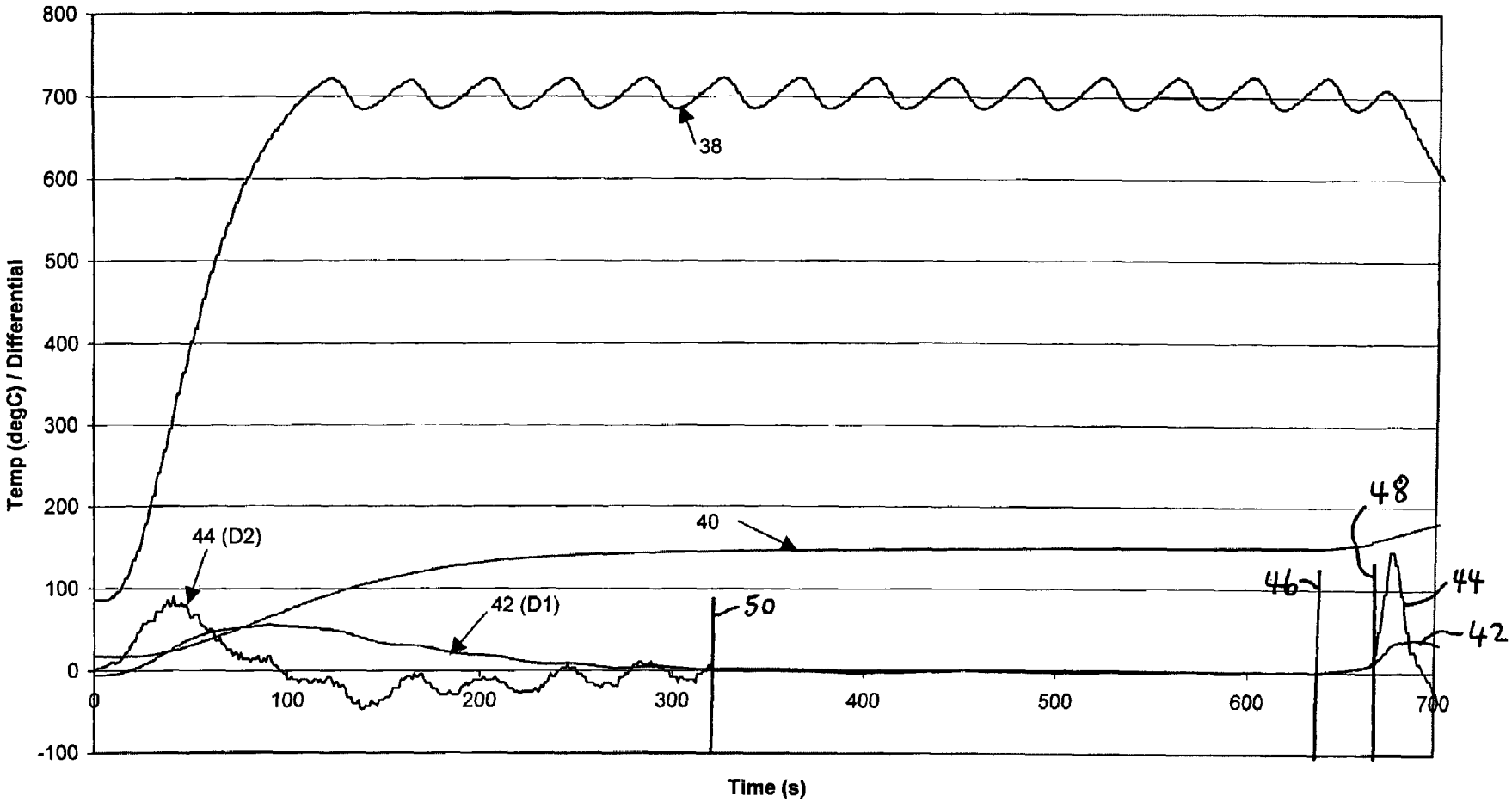
FIG. 2 is a graphical representation of plots of temperature against time derived by first and second temperature-responsive devices in the arrangement of FIG. 1 and showing first and second derivative plots derived therefrom by processing circuitry for boil-dry detection in a cooking utensil and de-energising of a heater of FIG. 1.

The processing circuit 28, in association with the second temperature-responsive device 26, operates to monitor the temperature of the cooking utensil 10 through the cooking surface 4 within the cooking zone 8, as indicated by reference numeral 40 in FIG. 2. It is also arranged to measure the rate at which the temperature of the cooking utensil 10 changes during the entire operating time of the arrangement and over the entire operating temperature range thereof. The monitoring of the temperature of the cooking utensil 10 is effected at predetermined time intervals, which may be between 0.1 and 4 seconds, preferably between 0.3 and 1 second and suitably about 0.5 second.

The processing circuit 28 is arranged to calculate a first derivative D1 with time of the temperature sensed by the second temperature-responsive device 26. This is shown by reference numeral 42 in FIG. 2. The processing circuit 28 is also arranged to calculate a second derivative D2 with time of the temperature sensed by the second temperature-responsive device 26. This is shown by reference numeral 44 in FIG. 2.

If the cooking utensil 10 boils dry, as indicated by reference numeral 46 in FIG. 2, the rate of temperature rise of the utensil, sensed by the second temperature-responsive device 26, will increase and this is accompanied by a corresponding increase in values of the first and second derivatives D1 and D2. If the values of the first and second derivatives D1 and D2 exceed predetermined trip or threshold levels, the processing circuit 28 operates to de-energise the heater 6, as indicated by reference numeral 48 in FIG. 2, to prevent damage resulting from the boil-dry event in the cooking utensil 10. Instead of, or in addition to, the heater 6 being de-energised, a warning signal means, which may be audible, may be activated. In the present example, de-energising of the heater has been effected within about 15 seconds of the boil-dry event occurring.

A further safeguard for the arrangement 2 is provided in that if the temperature sensed by the second temperature-responsive device 26 exceeds a predetermined maximum value, the circuit 28 operates to de-energise the heater 6.

An essential feature of the present invention is the operation of the arrangement in a stabilising mode prior to operation in a running mode. During operation in the stabilising mode, the first derivative D1 is monitored with time. Only when the first derivative D1 has assumed a stable value within predetermined threshold limit values for a predetermined time period, suitably of about 20 seconds, will progression to the running mode occur in which the trip or threshold limits specified for D1 and D2 become operative and the boil-dry event can be detected. Stabilisation of the first derivative D1 is indicated by line 50 in FIG. 2, the stabilising mode occurring to the left of line 50 and the running mode occurring to the right of line 50.

In practice, one or more of the following further provisions may be required to be met before stabilisation is achieved and progression from the stabilisation mode to the running mode of operation occurs. The power to the heater 6 must be remaining substantially constant. Alternatively or additionally, a set-point temperature of the cooking surface 4, determined by the control circuit 28 co-operating with the first temperature-responsive device 24, must remain constant within predetermined limits, such as ±6 degrees Celsius. Alternatively or additionally further, the temperature sensed by the second temperature-responsive device 26 must not decrease by more than a predetermined amount to the extent that negative threshold limit values, specified for the first and second derivatives D1 and D2, are exceeded. As will be described in greater detail hereinafter, such decrease in temperature may occur, for example, if at some stage of being heated the cooking utensil 10 is topped up with cold water. The temperature would then decrease, followed by a subsequent increase as the water heats up again, which could lead to an erroneous impression being given to the processing circuit that a boil-dry event has occurred. Consequently, if the above further provisions are not met, the stabilising mode of operation is arranged to be automatically re-selected.

Figure 3:
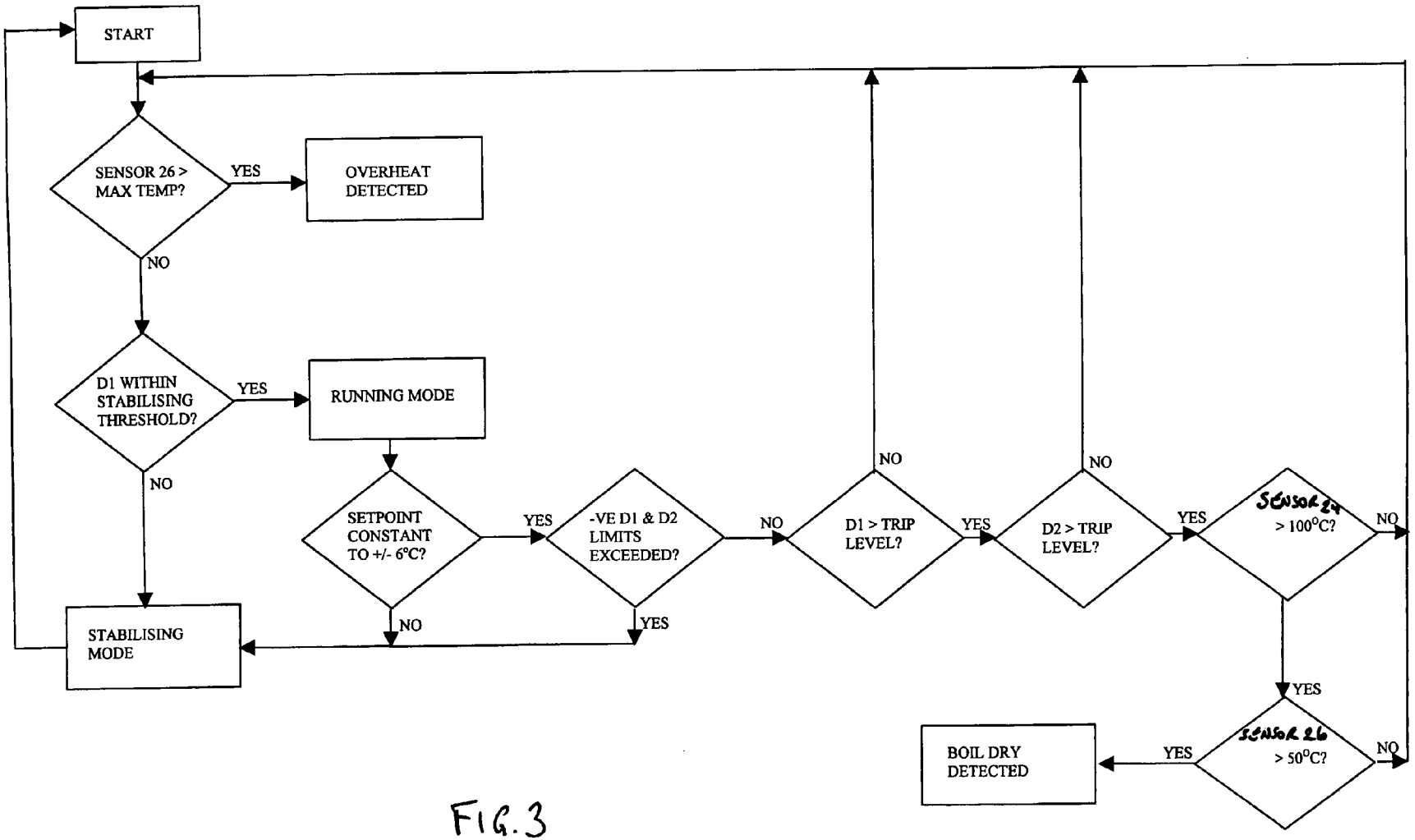
FIG. 3 is a flow chart illustrating operation of the arrangement of FIGS. 1 and 2.

The flow chart of FIG. 3 summarises operation of the arrangement of the present invention. The temperature sensed by the second temperature-responsive device 26 is checked to ensure that it has not reached a predetermined maximum value set in relation to the cooking utensil 10 through the cooking surface 4. If it has, this indicates an over-heating condition and the heater 6 is automatically de-energised for safety purposes. If it has not, the stabilising mode of operation progresses, with the first derivative D1 being monitored until it is within its stabilising threshold limits for the predetermined period of time. Progression to the running mode of operation then occurs, provided any of the provisions referred to hereinabove are met with regard to the maintenance of the set-point temperature in the cavity 22, and/or maintenance of constant power to the heater, and/or there is substantially no decrease in temperature sensed by the second temperature-responsive device 26. If any of these provisions are specified and are not met, the stabilising mode of operation is automatically re-selected. The running mode progresses and if the first and second derivatives D1 and D2 exceed their respective predetermined trip or threshold values, indicating a boil-dry event in the cooking utensil 10, the heater 6 is de-energised and/or a warning signal activated.

When the arrangement 2 is operating in stabilising mode, the predetermined trip or threshold levels are arranged to be inoperative, in order to prevent the system from inadvertently acting as if it were detecting a boil-dry event, such as when a temperature controller is adjusted upwards, resulting in increased first and second derivative output values. The system may be arranged to enter the stabilising mode of operation whenever the temperature controller is adjusted by more than a few degrees, for example more than six degrees Celsius.

When the second temperature-responsive device 26 measures the temperature of the cooking utensil 10 through the cooking surface 4 at the predetermined time intervals or sampling periods, temperature values are entered into a stabilising buffer, where they are averaged. The average temperature in the stabilising buffer is calculated and entered into a first derivative (D1) buffer. The average value of the first derivative (D1) buffer is calculated and entered into a second derivative (D2) buffer. The buffers operate continually such that a first (D1) and second (D2) derivative value is outputted at each of the predetermined time intervals, suitably every 0.5 second.

The stabilising buffer duration may be between 5 and 50 seconds, a preferred duration being between 5 and 20 seconds.

Tests have shown that the stabilising time varies significantly according to the type and quantity of the material 12 being heated in the cooking utensil 10. For this reason a fixed time interval will not be appropriate for the range of materials and quantities envisaged.

After the temperature monitored by the second temperature-responsive device 26 has been measured and entered into the stabilising buffer, where it is averaged, the first derivative value, $dT/dt=K_1(T_{rba}-T_{rbap})/t_s$, is calculated and entered into the first derivative rolling buffer. (In the above equation, $t_s$=sampling period, $T_{rba}$=rolling buffer average temperature, $T_{rbap}$=rolling buffer average temperature for the previous sampling period $t_s$, and $K_1$ is a constant). The average value $dT_{rba}/dt$ of the first derivative rolling buffer is calculated and output as the first derivative D1. The second derivative value, $d^2T/dt^2=Q_1\times(dT_{rba}/dt-dT_{rbap}/dt)/t_s$, is calculated and placed in the second derivative rolling buffer. (Here, $dT_{rbap}/dt$ is the average of the first derivative rolling buffer for the previous sampling period $t_s$ and $Q_1$ is a constant). The average value $d^2T_{rba}/dt^2$ of the second derivative rolling buffer is calculated and output as the second derivative D2. When both the first and second derivative outputs are above their respective predetermined trip or threshold levels, power to the heater 6 is terminated and/or a warning signal means activated.

In the stabilising mode of operation, the first and second derivative buffers are suitably arranged to be about 10 seconds long. This results in noisier (or more erratic) first and second derivative outputs. This prevents the system from stabilising too soon and subsequently de-energising the heater when there is in fact no boil-dry event. The noisy signal means that the system will not enter its running mode of operation until it is truly stable. For example, the first derivative D1 should be arranged to remain between minus 10 and plus 10 for a period of not less than 20 seconds.

In the running mode of operation, examples of conditions which may be arranged to be satisfied for a boil-dry event to be detected and responded to are:

1. The temperature sensed by the first temperature-responsive device 24 is above 100 degrees Celsius;
2. The temperature sensed by the second temperature-responsive device 26 is above 50 degrees Celsius;
3. The first derivative D1 is between 1 and 50 and preferably between 2 and 10;
4. The second derivative D2 is between 1 and 50 and preferably between 1 and 10.

The arrangement of the present invention operates well to rapidly detect boil-dry events for cooking utensils 10 containing a liquid, such as water, and also for cooking utensils containing water and materials, such as vegetables, which tend not to adhere to a base of the utensil. However, starchy food materials cooked in milk or water often start to adhere to the base of the cooking utensil while there is still a substantial volume of liquid remaining, which is unsatisfactory and required to be detected. A starchy film adhering to the base of the cooking utensil results in an increase in temperature which is detectable by the second temperature-responsive device 26. Although this temperature rise is very gradual, it is sufficient to produce peaks in the first and second derivatives D1 and D2, thereby enabling this condition to be detected before food is burned or the cooking utensil damaged. The arrangement works particularly well when cooking rice in water. When detection and de-energising of the heater takes place a slight starchy film results on the base of the utensil, with the rice being cooked and moist but with no excess liquid in the utensil. The starchy film can be easily stirred into the rice without disadvantage.

Figure 4:
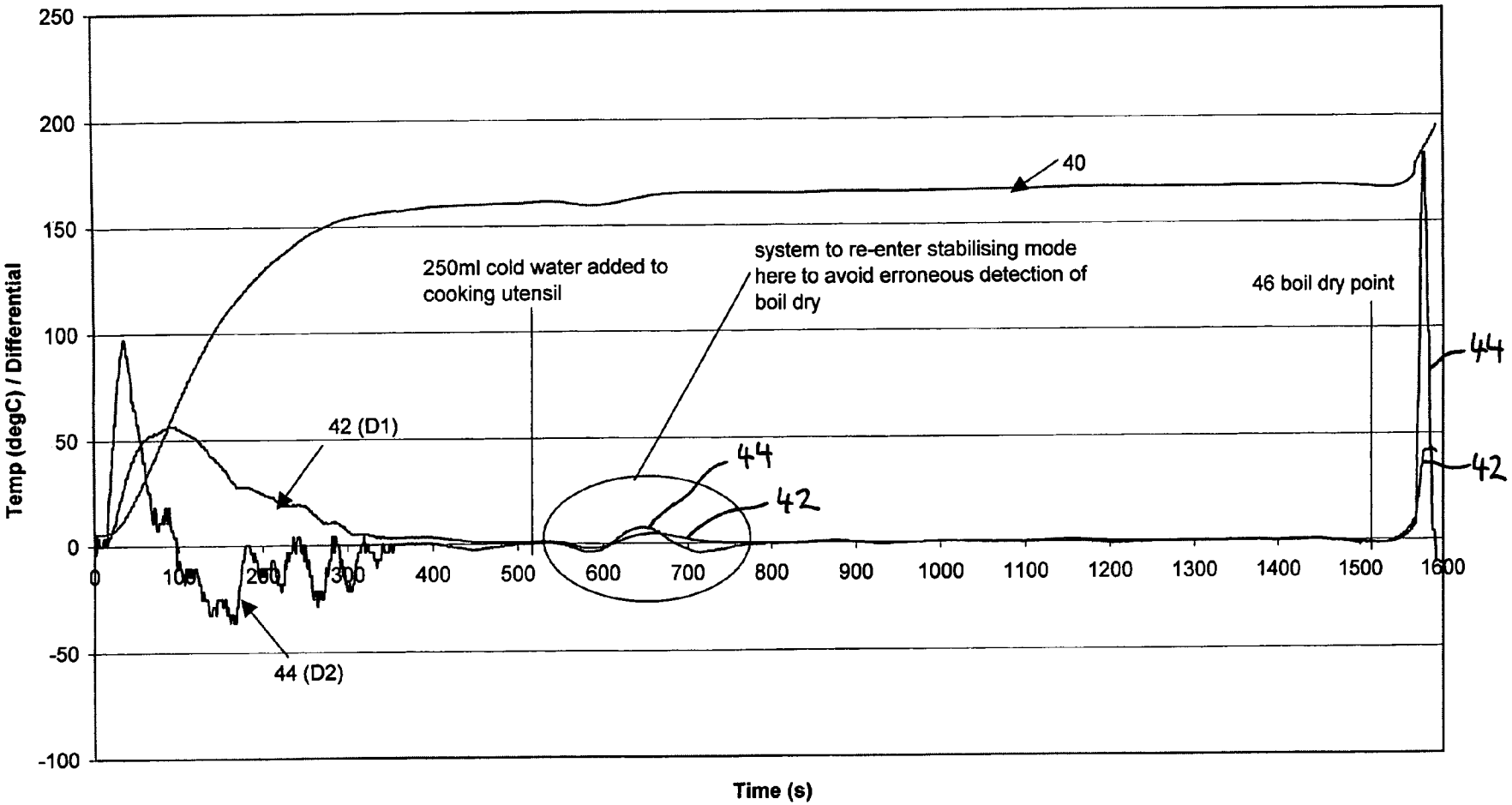
FIG. 4 is a graphical illustration of the effect of adding cold water to the cooking utensil during heating of water therein in the arrangement of the present invention.

As referred to previously, a situation may arise in which during heating of a liquid, such as water, in the cooking utensil 10, the cooking utensil may be topped up with further cold liquid. This results in a temporary fall in temperature in the cooking utensil 10, followed by a rise in temperature as further heating takes place. The arrangement of the present invention is adapted to deal with such a situation, which could otherwise be interpreted by the electronic circuitry as a boil-dry event. This is illustrated in FIG. 4. The cooking utensil 10 in the arrangement of FIG. 1 is provided with 500 ml of water and heated. The processing circuit 28, in association with the second temperature-responsive device 26, operates to monitor the temperature of the cooking utensil 10, within the cooking zone 8, with time, as indicated by reference numeral 40. The first and second derivatives D1 and D2 are calculated, a plot of the first derivative D1 being indicated by reference numeral 42 and a plot of the second derivative D2 being indicated by reference numeral 44. The system operates in the stabilising mode until the first derivative D1 (reference numeral 42) is stable and remains so for the predetermined time period. The running mode of operation is then instigated. However, during the running mode of operation 250 ml of cold water are added to the cooking utensil 10. This action results in a fall in temperature, sensed by the second temperature temperature-responsive device 26 (and shown on the curve 40 in FIG. 4) followed by a rise in temperature as the water heats up again. The first and second derivatives D1 and D2 follow this fall and subsequent rise in temperature, as indicated by their plots (reference numerals 42 and 44 respectively) within the circled region 52 in FIG. 4. The first and second derivatives assume decreasing (negative) values followed by increasing values, in this region 52. If the system were to continue in running mode, a false impression would be given by the increasing values of the first and second derivatives that a boil-dry event was occurring in the cooking utensil 10. To avoid this, the system is adapted such that when the cold water is added and the temperature falls, then, if the first and second derivatives D1 and D2 assume negative values in excess of certain predetermined limit values, the system immediately reverts to its stabilising mode of operation, until the first derivative D1 is again stable and remains so within its predetermined threshold limit values. A suitable negative limit value for both the first and second derivatives may, for example, be about −2. The running mode is then re-entered, leading to satisfactory detection of a boil-dry event in the cooking utensil 10 (point 46 in FIG. 4) and correct de-energising of the heater 6.

Figure 5:
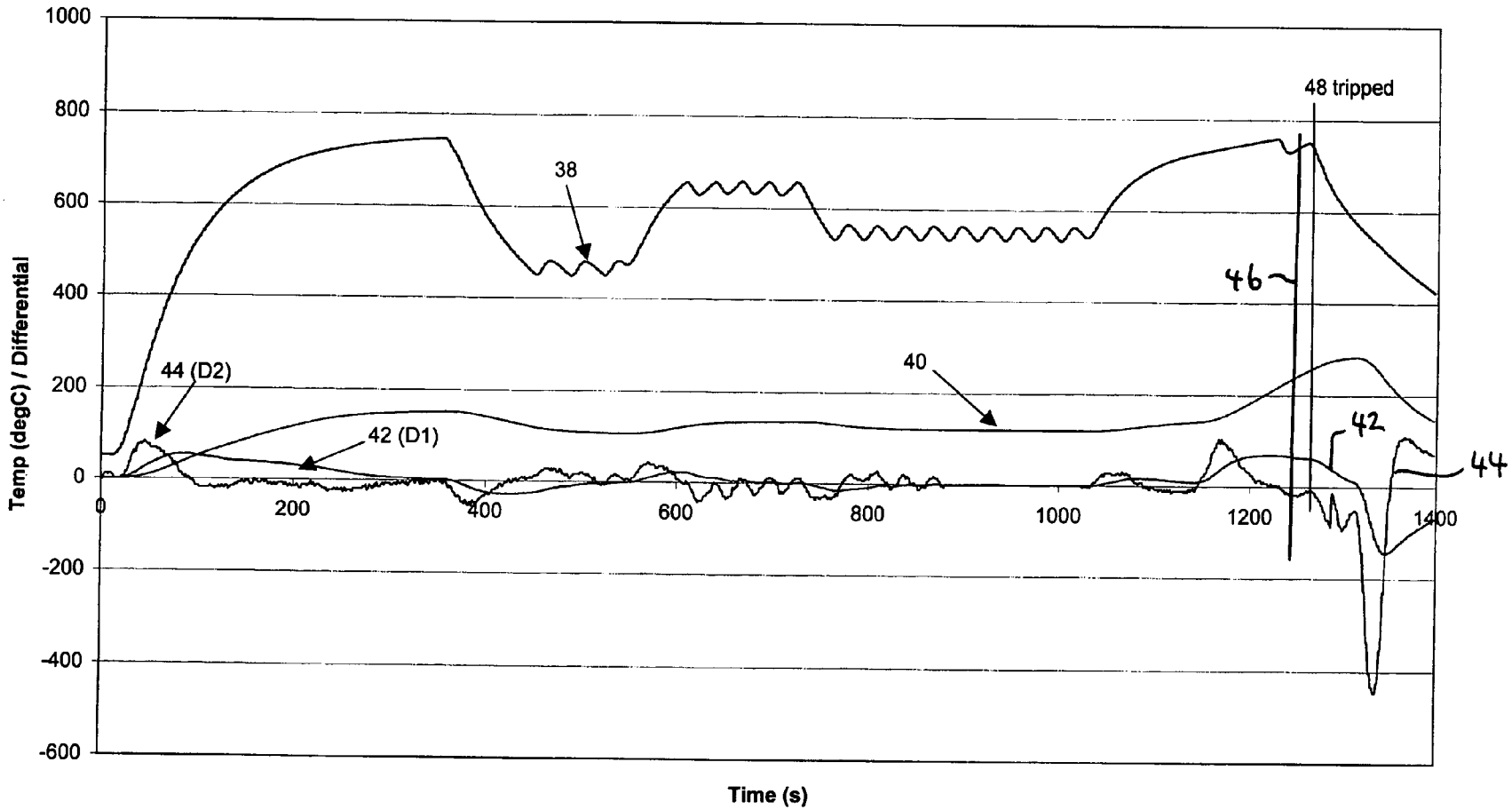
FIGS. 5 and 6 are graphical representations of plots of temperature against time derived by first and second temperature-responsive devices in modifications to the arrangement of FIGS. 1 and 2 and showing first and second derivative plots derived therefrom by the processing circuitry for boil-dry detection in the cooking utensil and de-energising of the heater.

A modification to the arrangement of FIGS. 1 and 2 is illustrated in FIG. 5. Here, the cooking utensil 10, containing 500 ml of water, is heated at a set-point temperature of 700 degrees Celsius for 6 minutes. It is then switched down to a set-point temperature of 400 degrees Celsius for 3 minutes and then switched up to a set-point temperature of 600 degrees Celsius for 3 minutes. It is then switched down to a set-point temperature of 500 degrees for 5 minutes and finally switched up again to 700 degrees Celsius until boil-dry occurs.

As in FIG. 2, the controlled excursions of the set-point temperature with time are indicated by reference numeral 38. The temperature of the cooking utensil 10, as monitored with time by the second temperature-responsive device 26, is indicated by reference numeral 40. The plot of the first derivative D1 is indicated by reference numeral 42 and the plot of the second derivative D2 is indicated by reference numeral 44. A boil-dry event occurs at point 46 and tripping or de-energising of the heater 6 occurs about 20 seconds later at point 48. It is seen that for each different set-point temperature stage the arrangement operates in its stabilising mode until the first derivative D1 (reference numeral 42) is stable and remains so, within its predetermined limits, for the predetermined time. The boil-dry event is detected in the final running mode of operation when the values of the first and second derivatives D1 and D2 exceed predetermined threshold levels.

Figure 6:
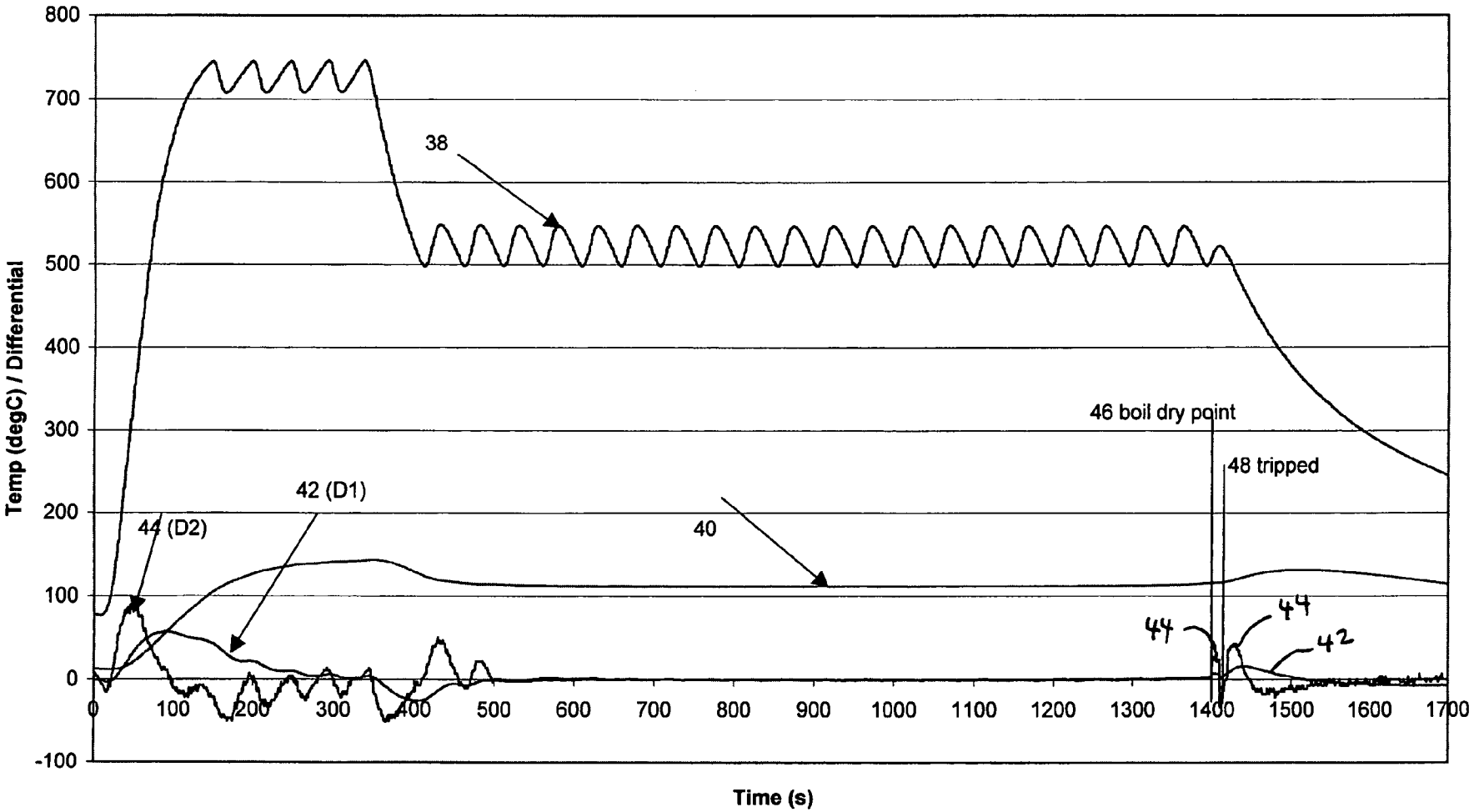

FIG. 6 illustrates a further modification to the arrangement of FIGS. 1 and 2. Here, the cooking utensil 10 containing 750 grams of potatoes in 45 to 55 gram pieces, 250 ml of water and one teaspoonful of salt, is heated at a set-point temperature of 700 degrees Celsius until boil-dry occurs. As in FIG. 2, the plot of the set-point temperature with time is indicated by reference numeral 38. The temperature of the cooking utensil 10, as monitored with time by the second temperature-responsive device 26, is indicated by reference numeral 40. The plot of the first derivative D1 is indicated by reference numeral 42 and the plot of the second derivative D2 is indicated by reference numeral 44. A boil-dry event occurs at point 46 and tripping or de-energising of the heater 6 occurs about 37 seconds later at point 48. Once again, the arrangement operates in its stabilising mode until the first derivative D1 (reference numeral 42) is stable and remains so, within its predetermined limits, for the predetermined time. The boil-dry event is detected in the subsequent running mode of operation when the values of the first and second derivatives D1 and D2 exceed predetermined threshold levels.

We claim:

1. Apparatus for detecting an abnormal rise in temperature as-sociated with a combination of a cooking utensil and a cooking surface overlying an electric heater, the apparatus comprising: a first temperature-responsive device adapted to monitor temperature of the cooking surface; a second temperature-responsive device adapted to monitor temperature of the cooking utensil and to provide an electrical output as a function of temperature of the cooking utensil; means for calculating first and second derivatives with time of the temperature sensed by the second temperature-responsive device over an operating temperature range of the heater; means for monitoring the first derivative of time so as to determine stabilisation of the first derivative within stabilising threshold limit values for a predetermined time; and means to compare, once stabilisation has been detected, the first and second derivatives with first and second predetermined threshold values and to detect an abnormal rise in temperature when the first and second predetermined threshold values are exceeded.

2. Apparatus as claimed in claim 1, wherein the first temperature-responsive device is adapted to provide an output as a function of the temperature of the cooking surface.

3. Apparatus as claimed in claim 2, wherein the first temperature-responsive device is electrically connected to means for monitoring temperature of the cooking surface sensed thereby with time.

4. Apparatus as claimed in claim 1, wherein the means to determine stabilisation of the first derivative within the stabilising threshold limit values comprises a stabilising mode of operation of the heater, which is effected until the first derivative is stable within the stabilising threshold limit values for a predetermined period of time, and during which the first and second predetermined threshold values are arranged to be inoperative, whereby spurious detection of an abnormal rise in temperature is avoided, the stabilising mode of operation being followed by a running mode of operation during which the first and second predetermined threshold values are operative.

5. Apparatus as claimed in claim 4, wherein the predetermined period of time is about 20 seconds.

6. Apparatus as claimed in claim 4, wherein the running mode of operation progresses provided at least one of the following conditions is satisfied: power to the heater remains substantially constant; a set-point temperature of the cooking surface, determined by a control means for the heater co-operating with the first temperature-responsive device, remains constant within predetermined limits; and the temperature sensed by the second temperature-responsive device does not decrease by more than a predetermined amount as specified by negative threshold limit values for the first and second derivatives, otherwise the stabilising mode of operation is re-selected.

7. Apparatus as claimed in claim 1, wherein the first temperature-responsive device is arranged to operate to cause de-energising of the at least one heating element when it senses a predetermined maximum permitted temperature of the cooking surface.

8. Apparatus as claimed in claim 1, wherein the second temperature-responsive device is arranged to operate to cause de-energising of the heater when it senses a predetermined maximum permitted temperature of the cooking utensil.

9. Apparatus as claimed in claim 1, wherein: the second temperature-responsive device monitors the temperature of the cooking utensil at predetermined time intervals and temperature values are entered into a stabilising buffer, where they are averaged; the average temperature in the stabilising buffer is calculated and entered into a first derivative buffer; the average value of the first derivative buffer is calculated and entered into a second derivative buffer and the buffers operate continually such that a first and second derivative value is outputted at each of the predetermined time intervals.

10. Apparatus as claimed in claim 9, wherein the predetermined time intervals are between 0.1 and 4 seconds.

11. Apparatus as claimed in claim 10, wherein the predetermined time intervals are between 0.3 and 1 second.

12. Apparatus as claimed in claim 11, wherein the predetermined time intervals are about 0.5 second.

13. Apparatus as claimed in claim 1, wherein at least one of the first and second temperature-responsive devices is of electrical resistance temperature detector form.

14. Apparatus as claimed in claim 13, wherein the electrical resistance temperature detector is of platinum resistance temperature detector form.

15. Apparatus as claimed in claim 1, wherein the second temperature-responsive device is arranged in contact with or adjacent to the underside of the cooking surface.

16. Apparatus as claimed in claim 1, wherein microprocessor-based processing, calculating and control circuitry, operating with appropriate software algorithms, is provided for operation in association with the first and second temperature-responsive devices, the electric heater and a power supply.

17. Apparatus as claimed in claim 1, wherein the cooking surface comprises glass-ceramic material.

18. Apparatus as claimed in claim 1, wherein the abnormal rise in temperature associated with the combination of the cooking utensil and the cooking surface overlying the heater results from a boil-dry event in the cooking utensil or an event in which a food product adheres to a base of the cooking utensil.

19. Apparatus as claimed in claim 1, wherein the electric heater incorporates at least one electric heating element selected from a radiant electrical resistance heating element and an electrical induction heating element.

20. A method of detecting an abnormal rise in temperature associated with a combination of a cooking utensil and a cooking surface overlying an electric heater, comprising the steps of: monitoring, with a first temperature-responsive device, temperature of the cooking surface; monitoring, with a second temperature-responsive device, temperature of the cooking utensil and providing an electrical signal as a function of temperature of the cooking utensil; calculating first and second derivatives with time of the temperature sensed by the second temperature-responsive device over an operating temperature range of the heater; monitoring the first derivative with time so as to determine stabilisation of the first derivative within stabilising threshold limit values for a predetermined time; and comparing, once stabilization has been detected, the first and second derivatives with first and second predetermined threshold values to detect an abnormal rise in temperature when the first and second threshold values are exceeded.

21. A method as claimed in claim 20, wherein the first temperature-responsive device is adapted to provide an output as a function of the temperature of the cooking surface.

22. A method as claimed in claim 21, wherein the first temperature-responsive device is electrically connected to means for monitoring temperature of the cooking surface sensed thereby with time.

23. A method as claimed in claim 20, wherein the step of determining stabilisation of the first derivative within the stabilising threshold limit values comprises establishing a stabilising mode of operation of the heater, which is effected until the first derivative is stable within the stabilising threshold limit values for a predetermined period of time, and during which the first and second predetermined threshold values are arranged to be inoperative, whereby spurious detection of an abnormal rise in temperature is avoided, the stabilising mode of operation being followed by a running mode of operation during which the first and second predetermined threshold values are operative.

24. A method as claimed in claim 23, wherein the predetermined period of time is about 20 seconds.

25. A method as claimed in claim 23, wherein the running mode of operation progresses provided at least one of the following conditions is satisfied: power to the heater remains substantially constant; a set-point temperature of the cooking surface is constant within predetermined limits; and the temperature sensed by the second temperature-responsive device does not decrease by more than a predetermined amount as specified by negative threshold limit values for the first and second derivatives, otherwise the stabilising mode of operation is re-selected.

26. A method as claimed in claim 20, wherein the first temperature-responsive device is arranged to operate to cause de-energising of the at least one heating element when it senses a predetermined maximum permitted temperature of the cooking surface.

27. A method as claimed in claim 20, wherein the second temperature-responsive device is arranged to operate to cause de-energising of the heater when it senses a predetermined maximum permitted temperature of the cooking utensil.

28. A method as claimed in claim 20, wherein: monitoring of the temperature of the cooking utensil is effected at predetermined time intervals and temperature values are entered into a stabilising buffer, where they are averaged; the average temperature in the stabilising buffer is calculated and entered into a first derivative buffer; the average value of the first derivative buffer is calculated and entered into a second derivative buffer and the buffers operate continually such that a first and second derivative value is outputted at each of the predetermined time intervals.

29. A method as claimed in claim 28, wherein the predetermined time intervals are between 0.1 and 4 seconds.

30. A method as claimed in claim 29, wherein the predetermined time intervals are between 0.3 and 1 second.

31. A method as claimed in claim 30, wherein the predetermined time intervals are about 0.5 second.

32. A method as claimed in claim 20, wherein at least one of the first and second temperature-responsive devices is of electrical resistance temperature detector form.

33. A method as claimed in claim 32, wherein the electrical resistance temperature detector is of platinum resistance temperature detector form.

34. A method as claimed in claim 20, wherein the second temperature-responsive device is arranged in contact with or adjacent to the underside of the cooking surface.

35. A method as claimed in claim 20, wherein microprocessor-based processing, calculating and control circuitry, operating with appropriate software algorithms, is provided for operation in association with the first and second temperature-responsive devices, the electric heater and a power supply.

36. A method as claimed in claim 20, wherein the cooking surface comprises glass-ceramic material.

37. A method as claimed in claim 20, wherein the abnormal rise in temperature associated with the combination of the cooking utensil and the cooking surface overlying the heater results from a boil-dry event in the cooking utensil or an event in which a food product adheres to a base of the cooking utensil.

38. A method as claimed in claim 20, wherein the electric heater incorporates at least one electric heating element selected from a radiant electrical resistance heating element and an electrical induction heating element.

* * * * *